US006691445B2

(12) United States Patent
Williams

(10) Patent No.: US 6,691,445 B2
(45) **Date of Patent: *Feb. 17, 2004**

(54) DISABLEMENT MECHANISM FOR A FIREARM

(75) Inventor: Charles David Williams, Geneseo, IL (US)

(73) Assignee: Springfield, Inc., Geneseo, IL (US)

( * ) Notice: Subject to any disclaimer, the term of this patent is extended or adjusted under 35 U.S.C. 154(b) by 413 days.

This patent is subject to a terminal disclaimer.

(21) Appl. No.: 09/758,825

(22) Filed: Jan. 11, 2001

(65) Prior Publication Data

US 2001/0016999 A1 Aug. 30, 2001

Related U.S. Application Data

(63) Continuation-in-part of application No. 09/370,532, filed on Aug. 9, 1999.

(51) Int. Cl.[7] ..... F41A 17/00
(52) U.S. Cl. ..... 42/70.08
(58) Field of Search ..... 42/70.08

(56) References Cited

U.S. PATENT DOCUMENTS

| | | | | |
|---|---|---|---|---|
| 689,283 A | | 12/1901 | Browning | 42/70 |
| 911,683 A | | 2/1909 | Scott | 42/70 |
| 2,691,232 A | | 10/1954 | Hoopes | 42/70 |
| 2,803,910 A | | 8/1957 | Lyle | 42/70 |
| 2,945,316 A | | 7/1960 | Mulno | 42/66 |
| 2,994,981 A | | 8/1961 | Carrigan | 42/66 |
| 3,462,869 A | | 8/1969 | Wallace | 42/70 |
| 3,750,531 A | * | 8/1973 | Angell et al. | 89/148 |
| 3,762,089 A | * | 10/1973 | Meyer, Jr. | 42/70.08 |
| 4,021,955 A | | 5/1977 | Curtis | 42/70 |
| 4,306,487 A | | 12/1981 | Beretta | 89/148 |
| 4,312,263 A | | 1/1982 | Bourlet | 89/154 |

(List continued on next page.)

FOREIGN PATENT DOCUMENTS

BR PI 8904218 A 2/1991

OTHER PUBLICATIONS

U.S. patent application Ser. No. 60/198,525, Salvitti, filed Apr. 19, 2000.
U.S. patent application Ser. No. 09/837,922, Salvitti, filed Apr. 18, 2001.

*Primary Examiner*—Charles T. Jordan
*Assistant Examiner*—Denise J Buckley
(74) *Attorney, Agent, or Firm*—Woodard, Emhardt, Moriarty, McNett & Henry LLP

(57) ABSTRACT

A mechanism for disabling a firearm is provided. The disablement mechanism includes a body positionable to block movement of the hammer spring assembly in order to prevent the hammer from being moved to its cocked position.

20 Claims, 7 Drawing Sheets

U.S. PATENT DOCUMENTS

| | | | | | |
|---|---|---|---|---|---|
| 4,575,963 | A | | 3/1986 | Ruger et al. | 42/70.11 |
| 4,658,529 | A | * | 4/1987 | Bertolini | 42/70.08 |
| 4,672,763 | A | | 6/1987 | Cunningham | 42/70.11 |
| 4,726,136 | A | * | 2/1988 | Dornaus et al. | 42/70.08 |
| 4,763,431 | A | | 8/1988 | Allan et al. | 42/70.11 |
| 4,845,870 | A | * | 7/1989 | Vernon | 42/70.08 |
| 4,967,502 | A | | 11/1990 | Vernon | 42/70.08 |
| 5,081,779 | A | | 1/1992 | Pack | 42/70.11 |
| 5,090,147 | A | * | 2/1992 | Pastor | 42/70.05 |
| 5,225,612 | A | | 7/1993 | Bernkrant | 42/70.02 |
| 5,235,763 | A | | 8/1993 | Nosler et al. | 42/70.11 |
| 5,361,525 | A | | 11/1994 | Bowes | 42/70.11 |
| 5,517,780 | A | | 5/1996 | Haber et al. | 42/70.08 |
| 5,570,527 | A | | 11/1996 | Felicci | 42/70.08 |
| 5,581,927 | A | | 12/1996 | Meller | 42/70.11 |
| 5,621,995 | A | * | 4/1997 | Smith | 42/7 |
| 5,625,971 | A | | 5/1997 | Tuma et al. | 42/70.08 |
| 5,651,206 | A | | 7/1997 | Matarazzo | 42/70.08 |
| 5,666,754 | A | | 9/1997 | De Oliveira Masina | 42/70.08 |
| 5,671,560 | A | | 9/1997 | Meller | 42/70.11 |
| 5,680,722 | A | | 10/1997 | French et al. | 42/69.03 |
| 5,732,497 | A | | 3/1998 | Brooks | 42/70.11 |
| 5,743,039 | A | * | 4/1998 | Garrett | 42/70.11 |
| 5,749,166 | A | | 5/1998 | Brooks | 42/70.11 |
| 5,782,028 | A | | 7/1998 | Simon et al. | 42/70.11 |
| 5,910,003 | A | | 6/1999 | Kleinpaul | 42/70.11 |
| 6,205,694 | B1 | * | 3/2001 | Davis, Sr. | 42/69.03 |
| 6,257,116 | B1 | * | 7/2001 | Moczijdlower et al. | 89/155 |
| 6,269,576 | B1 | * | 8/2001 | Williams | 42/70.08 |
| 6,283,006 | B1 | * | 9/2001 | Szabo et al. | 89/147 |
| 2001/0037596 | A1 | | 11/2001 | Salvitti | 42/70.08 |

* cited by examiner

DISABLEMENT MECHANISM FOR A FIREARM

CROSS REFERENCE TO RELATED APPLICATIONS

The present application is a continuation-in-part of U.S. patent application Ser. No. 09/370,532 filed Aug. 9, 1999, now pending, which application is incorporated herein be reference in its entirety.

BACKGROUND OF THE INVENTION

The present invention relates generally to the field of firearms, and more particularly to a mechanism for disabling a firearm.

Auto-loading, automatic, and semi-automatic firearms have been in use for many years in the United States and throughout the world. Firearms are used by law enforcement personnel, military personnel, and individuals for various purposes such as, for example, self-defense, target shooting, and sport shooting, to name a few. One of the more popular models for auto loading handguns is found in the commonly referred to Model 1911 .45 caliber handgun (M-1911). Other types of semi-automatic or auto-loading firearms have also become popular over the years and are widely used. Given the availability of these firearms to the general public, one aspect of these firearms that has received much attention and debate over recent years has been the design of safety and locking devices. These devices are designed to prevent the accidental discharge or firing of the weapon.

One example of a design of a safety lock for a handgun is the subject of U.S. Pat. No. 5,081,779 to Pack. This patent describes a safety lock having a cam surface positioned below the bottom end of a shaft of a plunger. The plunger shaft extends through the internal spring. When the safety lock is engaged, the bottom end of the plunger shaft is blocked by the cam surface, thereby preventing the hammer from being cocked. The safety lock also defines a recess coaxial with the plunger shaft when the safety lock is disengaged. The recess allows downward movement of the plunger shaft as the hammer is cocked when the safety mechanism is disengaged. The '779 patent represents just one example of many types of prior art safety devices.

Although there have been many attempts to design safe and effective safety devices for firearms in the prior art, there remains a need for a mechanism that addresses the deficiencies in the prior art devices. For example, many prior art safety devices require substantial modifications to the components of the firearm in order for the safety device to work properly. In addition to substantial modifications to the firearm components, another problem with the prior art safety devices is that substantial modifications must be made to the frame of the firearm in order to accommodate the position of the safety device. Thus, for some safety devices, it is not feasible or even possible to retrofit an existing firearm with the device. Also, some prior art safety devices are comprised of several complex components, dramatically increasing the cost and effort of manufacturing, installing, and using the safety device.

The above describes just a few of the problems that exist with respect to devices designed to facilitate the safe use and handling of firearms. What is needed is a safety device that is enabled and disabled by the user in a safe, efficient and reliable manner. The device should be readily adaptable to installation in a variety of firearms. The device should also be readily adaptable for use in retrofitting an existing firearm, and in the manufacture and design of new firearms. The present invention satisfies these needs, among others.

SUMMARY OF THE INVENTION

The present invention provides a mechanism for a firearm positionable to disable the hammer spring assembly to prevent it from providing the required energy to cause the hammer to strike the firing pin.

In one aspect of the present invention, an apparatus for firing a cartridge is provided. The apparatus includes a firearm that has a hammer assembly movable between a cocked position and an uncocked position. The firearm also has a trigger assembly connected with the hammer that, when actuated, releases the hammer from the cocked position. The apparatus also includes a spring cap positioned on a main spring that is in contact with the hammer assembly. The main spring is tensioned upon cocking of the hammer assembly to thereafter cause the firearm to fire the cartridge when the trigger assembly is actuated. The apparatus also includes a disablement mechanism having a first position wherein the hammer assembly can be moved from the uncocked position to the cocked position. The disablement mechanism has a second position in contact with the spring cap to prevent the hammer assembly from being moved from the uncocked position to the cocked position. The spring cap is configured to prevent the disablement mechanism from being moved to the second position when the hammer is in the cocked position.

According to a further aspect of the present invention, a spring cap for a firearm is provided. The firearm includes a disablement mechanism and has a hammer movable between a cocked position and an uncocked position. A spring is positioned within a well of a spring housing. The spring is tensioned when the hammer is in the cocked position. The spring cap includes a shaft portion positionable in the spring and a head portion extending from the shaft portion that is positionable on the spring. The hammer is in contact with the head portion. The head portion is configured to prevent the disablement mechanism from disabling the firearm when the hammer is in the cocked position.

These and other aspects, forms, embodiments, features, advantages and objects of the present invention will be apparent from the following description of the illustrated embodiments.

DESCRIPTION OF THE PREFERRED EMBODIMENT

Figure 1:
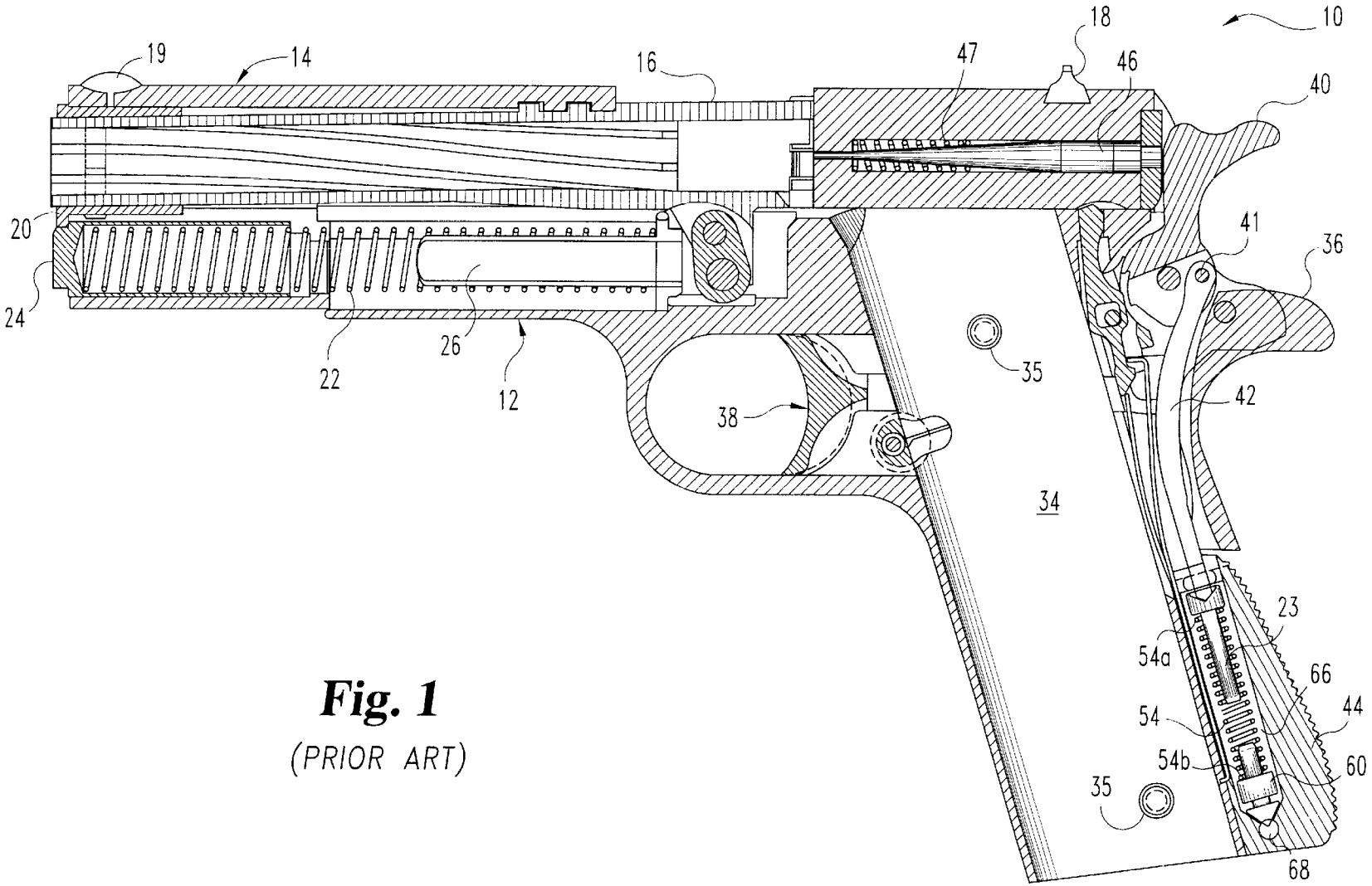
Fig. 1 (PRIOR ART)
FIG. 1 is a partial cross-sectional elevation view of a firearm with its hammer in the uncocked position.

For the purposes of promoting an understanding of the principles of the invention, reference will now be made to the embodiment illustrated in the drawings and specific language will be used to describe the same. It will nevertheless be understood that no limitation of the scope of the invention is thereby intended. Alterations and further modifications in the illustrated device, and such further applications of the principles of the invention as illustrated therein, are contemplated as would normally occur to one skilled in the art to which the invention relates.

Figure 2:
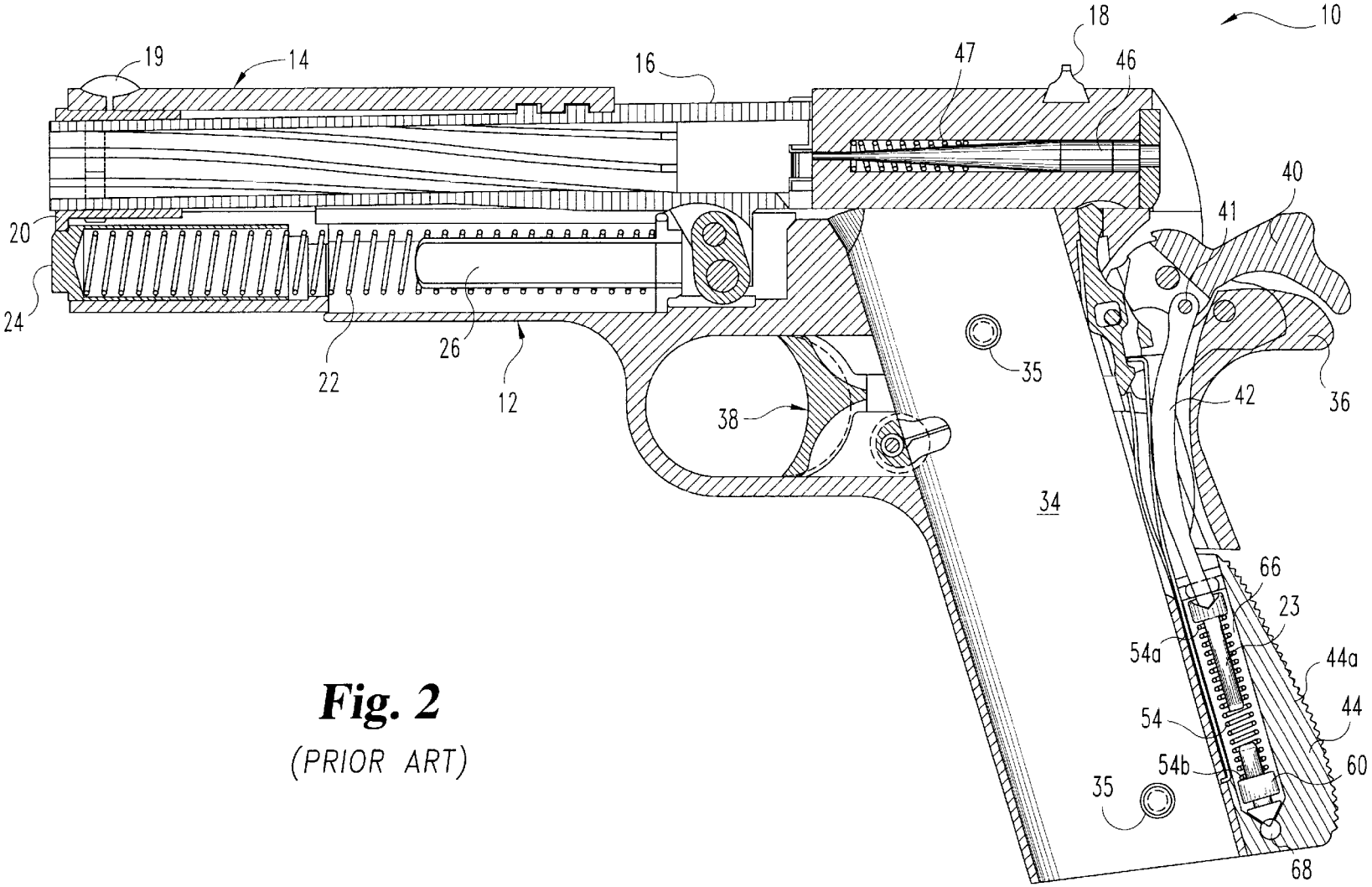
Fig. 2 (PRIOR ART)
FIG. 2 is the firearm of FIG. 1 with its hammer in the cocked position.
Figure 3:
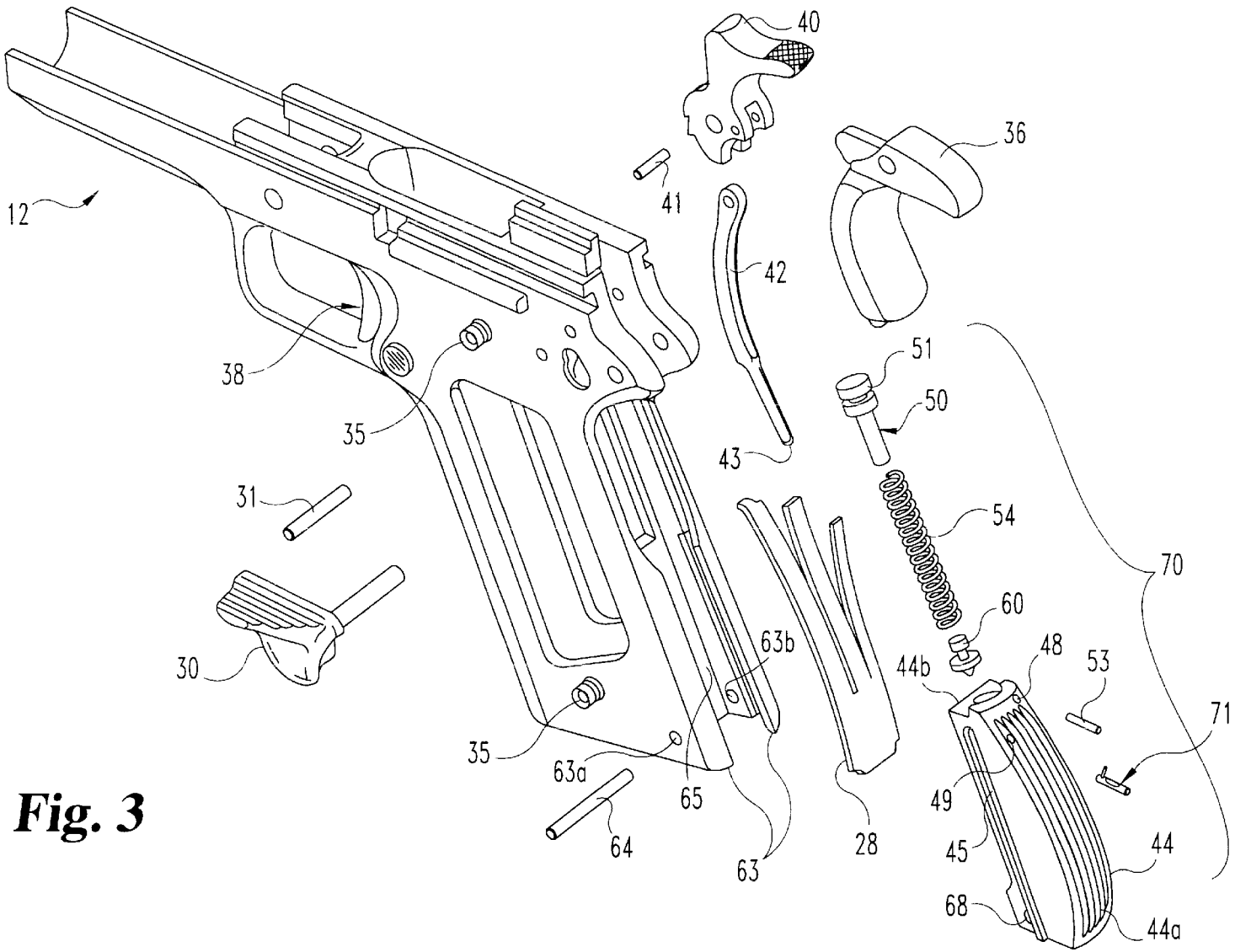
FIG. 3 is a exploded view of a portion of the firearm of FIG. 1 with a disablement mechanism according to the present invention.

Referring now to FIGS. 1–3, there is illustrated various views of a firearm 10 commonly known as the Model 1911 .45 caliber handgun. FIGS. 1–2 are provided to describe generally the components of a type of firearm with which a disablement mechanism 70 may be used. FIGS. 1–2 are also provided to show various operational conditions of the firearm 10. For example, in FIG. 1 the hammer 40 is in the uncocked position, and in FIG. 2 the hammer 40 is in the cocked position. It should be noted that disablement mechanism 70 is not shown in FIGS. 1–2, but rather is shown in FIGS. 3–9.

The environment in which disablement mechanism 70 functions is described herein by general reference to the various components of the Model 1911 handgun. However, it will be appreciated by those skilled in the art that the present invention has application with many types and models of firearms, and no limitation to the scope of the present invention is intended herein by any specific references to the components of the M-1911. Other models of semi-automatic or self-loading firearms may include components that differ from those described with respect to the M-1911; however, the disablement mechanism 70 also has application to such firearms so long as the principles of the present invention are met.

Figure 9:
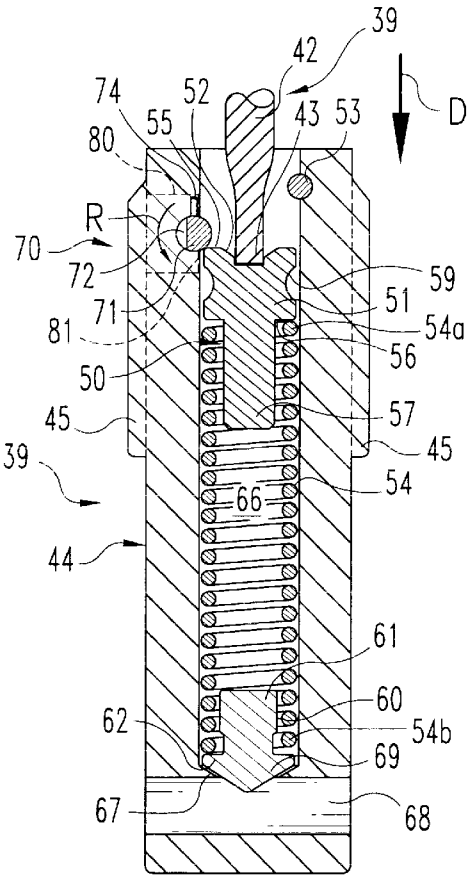
FIG. 9 is the view of FIG. 7 with the disablement mechanism in the engaged position after the hammer has been cocked.
Figure 8:
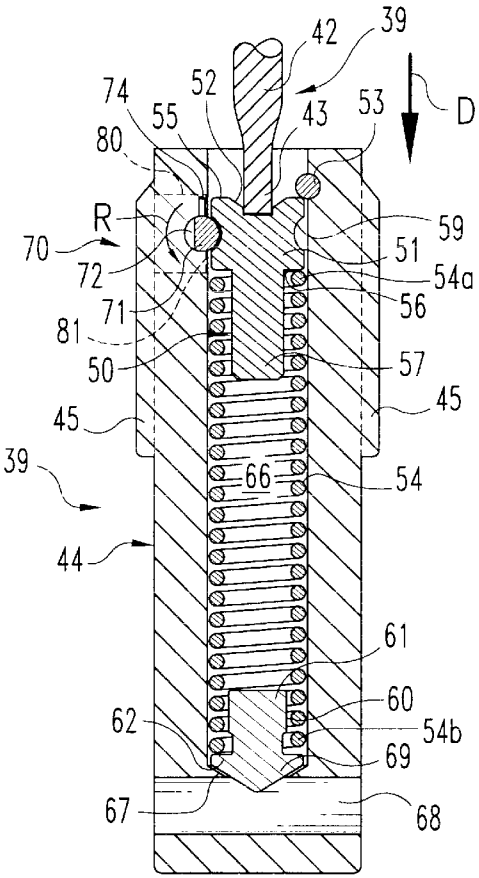
FIG. 8 is the view of FIG. 7 with the disablement mechanism in the engaged position.
Figure 7:
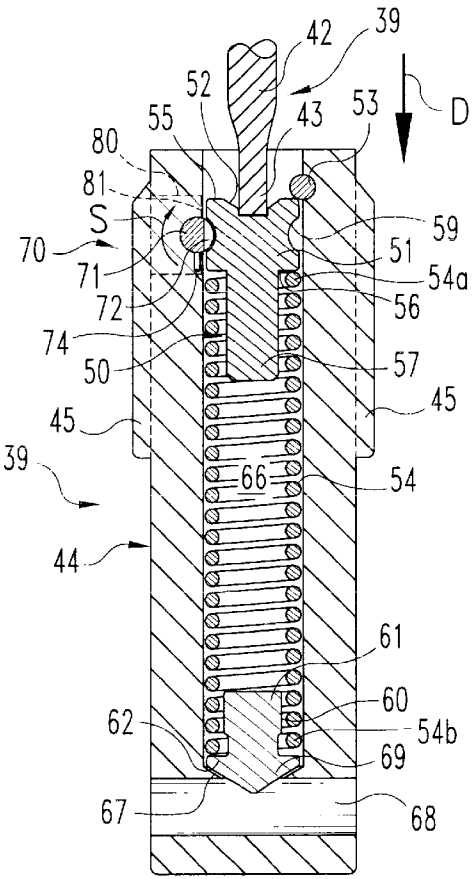
FIG. 7 is a cross-sectional view taken through line 7—7 of FIG. 5 with the disablement mechanism in the unengaged mechanism.

As shown in FIGS. 7–9, the present invention is directed to a disablement mechanism 70 that is positionable to contact a hammer or main spring cap 50 forming part of a hammer spring assembly 39 to disable the firearm 10. When hammer 40 is in the uncocked position, the disablement mechanism 70 is positionable within a groove 59 formed in a head portion 51 of spring cap 50 (FIG. 8.) The hammer 40 is thus prevented from moving from the uncocked position until the disablement mechanism is disengaged as shown in FIG. 7. When the hammer 40 is in the cocked position, the disablement mechanism 70 is positionable to contact a top surface 55 of spring cap 50 (FIG. 9) when the hammer is released from its cocked position. The disablement mechanism 70 prevents main spring 54 from providing the requisite energy to hammer 40 to cause it to strike firing pin 46 with sufficient force to discharge a cartridge upon actuation of the trigger. When disablement mechanism 70 is not engaged (FIG. 7,) hammer spring assembly 39 is free to move with respect to a main spring housing 44.

Referring now to FIGS. 1–2, an example of a firearm 10 usable with the disablement mechanism of the present invention is illustrated. Firearm 10 includes a frame 12 having a slide 14 movably engaged thereto. A barrel 16 is disposed within the slide 14 and extends rearward from the muzzle end of the firearm. A barrel bushing 20 supports and maintains the positioning of the muzzle end of barrel 16, and slide 14 has a rear sight 18 and a forward sight 19 mounted thereon. A recoil spring 22 is positioned around a recoil spring guide 26. The recoil spring 22 is held in position within the slide 14 and frame 12 by plug 24. Disposed near the rearward end of slide 14 is firing pin 46 positioned within a firing pin spring 47. As is well known in the art, firing pin 46 is struck by hammer 40 to fire a cartridge (not shown), which propels a projectile through barrel 16.

Hammer 40 is pivotally connected with frame 12 via hammer pin 31 (FIG. 3) and is connected with a hammer strut 42 by hammer strut pin 41. Hammer strut 42 extends downward from hammer 40 to main spring housing 44. Hammer 40 is pivotable about hammer strut pin 41 between the uncocked position shown in FIG. 1 to the cocked position shown in FIG. 2, as is well known in the art. Hammer spring or main spring housing 44 has a gripping surface 44*a* that contacts the palm of the shooter's hand. Main spring housing 44 also defines a well 66 for receiving a main spring 54. As shown in FIGS. 1–2, a hammer spring or main spring cap 23 is positioned at the upper end 54*a* of main spring 54. Spring cap 23 is in abutting engagement with an end 43 of hammer strut 42. Also positioned within well 66 at the bottom end 54*b* of spring 54 is a pin retainer 60. Pin retainer 60 contacts the main spring holding pin 64, which extends through pin bore 68 of main spring housing 44.

Firearm 10 also includes grip safety 36 that allows actuation of a trigger assembly 38. As is well known in the art, actuation of trigger assembly 38 releases hammer 40 from the cocked position so it can move from to the uncocked position with energy provided from main spring 54, thus initiating the firing of a cartridge from the firearm 10. On each side of frame 12 are stocks 34 mounted to the frame 12 by stock bushings 35.

Referring now to FIG. 3, there is shown an exploded view of frame 12 of firearm 10 and various components assembled thereto. FIG. 3 differs from FIGS. 1–2, however, in that the disablement mechanism 70 is provided with firearm 10. A spring cap 50 is provided in place of the spring cap 23 shown in FIGS. 1–2. Also, main spring housing 44 includes a bore 49 therethrough to receive the body 71.

A leaf spring 28 is positioned adjacent rearward face 65 of frame 12 between rearward face 65 and main spring housing 44 between inwardly projection portions 63. Main spring housing 44 is secured to the frame 12 with guide rails 45 positioned on either side of main spring housing 44. Guide rails 45 are slidingly received between inwardly projecting portions 63. Main spring holding pin 64 is inserted through apertures 63*a*, 63*b* and through pin bore 68 of main spring housing 44 to connect main spring housing 44 therewith. Firearm 10 also includes a safety lock 30 attached to frame 12 to lock hammer 40 in its cocked position, as is well known in the art.

Figure 4:
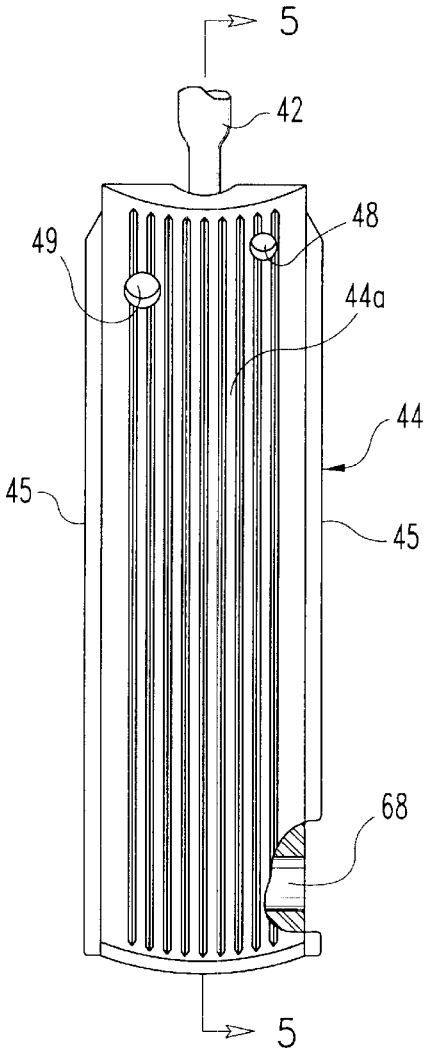
FIG. 4 is a rear elevational view of a portion of the firearm of FIG. 3.

Referring now to FIG. 4, a partially fragmented elevational view of main spring housing 44 along with hammer strut 42 extending therefrom is provided. Main spring housing 44 includes a block bore 48 formed therethrough from gripping surface 44*a* and communicating with well 66. A hammer spring or main spring block 53 (FIG. 3) is inserted through block bore 48 in order to contact top 55 of spring cap 23 or 50 to block main spring 54, spring cap 23 or 50, and retainer 60 within well 66 of main spring housing 44, as shown in FIG. 7. Block 53 is provided to prevent the tension on main spring 54 to cause these components to "jump" out of main spring housing 44 as it is removed from firearm 10. Of course, block 53 permits sufficient upward displacement of main spring 54 to cause hammer 40 to strike firing pin 46 when the trigger is actuated.

Figure 5:
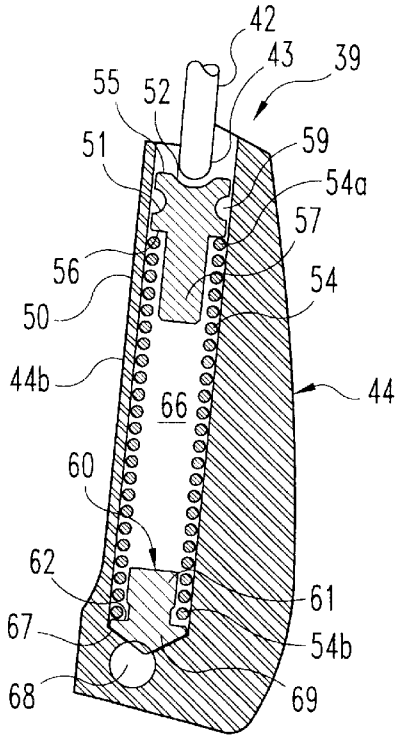
FIG. 5 is a cross-sectional view taken through line 5—5 of FIG. 4.

Referring now to FIG. 5, spring cap 50 includes a head portion 51 extending above and resting upon spring 54, and a shaft 57 received within main spring 54. Spring cap 50 includes an upper surface 55 having a recessed portion 52. Hammer strut 42 has an end 43 abutting spring cap 50 within recessed portion 52. At the junction of head portion 51 and shaft 57 is a shoulder 56 resting upon upper end 54*a* of main spring 54. Main spring 54 extends downward within well 66 to lower end 54*b* of main spring 54. Pin retainer 60 is positioned at lower end 54*b* of main spring 54. Pin retainer 60 includes an engagement end 69 extending into bore 68. The bottom of well 66 has a tapered portion 67 communicating with pin bore 68. When spring housing 44 is assembled to frame 12, engagement end 69 is received within tapered portion 67 to contact the outer surface of housing pin 64. Pin retainer 60 also includes shaft portion 61 extending towards spring cap 50 within main spring 54. Main spring 54 rests upon a bearing surface 62 formed between shaft portion 61 and engagement end 69.

Figure 6A:
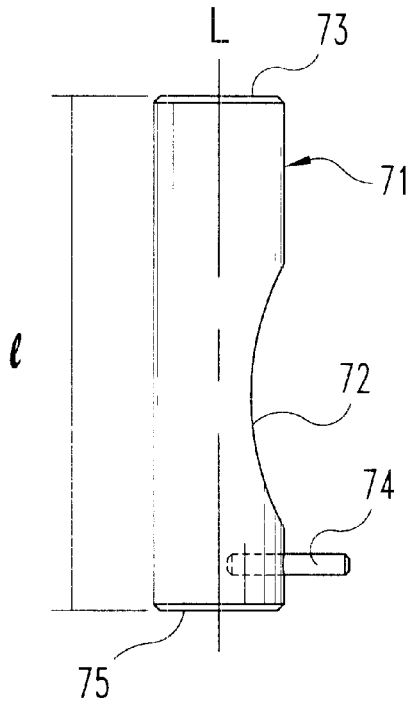
FIGS. 6*a*–6*c* are top, side and end elevation views, respectively, of a component of the disablement mechanism of the present invention.
Figure 6B:
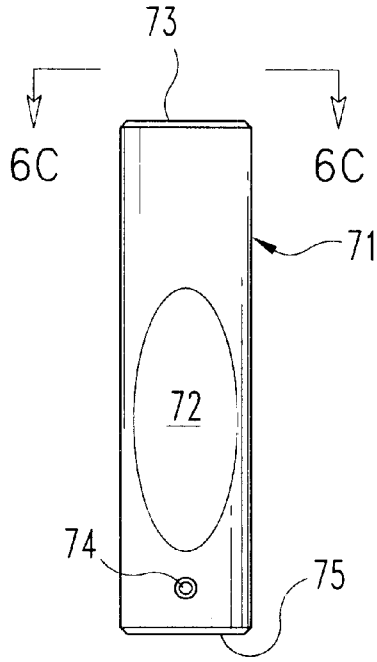
Figure 6C:
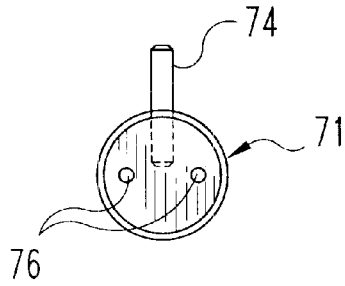

Main spring housing 44 defines a bore 49 for receiving a body 71. Bore 49 preferably extends between gripping surface 44*a* (FIG. 4) and a rearward face 44*b* of main spring housing 44. In a most preferred form, body 71 is cylindrical as shown in FIGS. 6*a*–6*c*, and is rotatably received with the bore 49. As described above, body 71 is positionable within bore 49 to contact spring cap 50 when hammer 40 is in the uncocked position to disable firearm 10. Body 71 is also positionable within bore 59 to disable firearm 10 when hammer 40 is trigger actuated from its cocked position.

Referring now to FIGS. 6*a*–6*c*, body 71 as a length "l" that extends between a first end 73 and an opposite second end 75. Preferably, length "l" is sufficient for body 71 to extend through bore 49 so that first end 73 is aligned with gripping surface 44*a* and second end 75 is aligned with rearward face 44*b*. Body 71 preferably includes threads on its exterior along at least a portion of length "l" so that body 71 may be threadedly received by mating engagement threads formed in bore 49. Other means for retaining body 71 within bore 49 are also contemplated herein. For example, body 71 can be press fit within the bore 49, or body 71 may reciprocate within bore 49, so long as body 71 is positionable to disable firearm 10.

In a most preferred form, first end 73 includes tool engagement openings 76. Tool engagement openings 76 are configured for receiving a tool or key (not shown) for positioning body 71 between a first position where firearm 10 is enabled for firing and a second position where firearm 10 is disabled, as described more fully below. Preferably, body 71 is rotated about its longitudinal axis L within the bore 49. Positioned adjacent second end 75 is a stop 74 extending substantially perpendicular to axis L of body 71. Preferably, stop 74 is press fit into a bore in the body 71, but may also be attached to body 71 by other means, such as, for example, threaded engagement. Stop 74 limits the rotation of block 70 between the positions described below where firearm 10 is enabled and the position where firearm 10 is disabled.

Body 71 defines along a portion of its length L a notch 72. Notch 72 is preferably semi-circular in shape and is dimensioned to conform with to the curvature of well 66 so that when the disablement mechanism is not engaged (firearm 10 is enabled) spring cap 50 is free to move within well 66. It is also contemplated herein that notch 72 has other shapes, such as a rectangular or a triangular shape.

Referring now to FIGS. 7–9, the operation of disablement mechanism 70 to enable and disable firearm 10 and its interaction with components of firearm 10 will now be described. Hammer spring assembly 39 includes hammer strut 42, spring cap 50, and main spring 54. Spring cap 50 includes head portion 51 and shaft portion 57. An upper surface 55 of head portion 51 defines recess 52 for receiving end 43 of hammer strut 42. Head portion 51 also defines shoulder portion 56 resting on end 54*a* of spring 54. Positioned between upper surface 55 and shoulder 56 is groove 59 extending circumferentially about head portion 51. Groove 59 preferably has a semi-circular cross section allowing body 71 to be rotatably received therein. Preferably, groove 59 has a size and shape substantially corresponding to that of body 71 for a smooth fit therewith.

FIG. 7 shows firearm 10 in an enabled condition with disablement mechanism 70 in a first position. Notch 72 of body 71 is positioned adjacent the spring cap 50. In this position, the hammer spring assembly 39 is free to move downward in the direction indicated by arrow D as hammer 40 is cocked, thus compressing spring 54 within main spring housing 44. In this first position, disablement mechanism 70 is disengaged and the firearm is enabled, i.e. it may be used as it normally would to fire a cartridge.

In order to disable the firearm when the hammer is uncocked, disablement mechanism 70 is moved to a second position where body 71 extends into spring well 66 as shown in FIG. 8. Body 71 is rotated from its position in FIG. 7 in the direction indicated by arrow S until the position shown in FIG. 8 is achieved, where firearm 10 is disabled. In this position, notch 72 is positioned away from the spring cap 50, and body 71 is received within groove 59 of spring cap 50. The hammer assembly 39 is prevented from moving in the direction of arrow D, and thus hammer 40 is unable to be moved from its uncocked position to its cocked position. Main spring 54 cannot be tensioned to impart the necessary energy to cause the hammer 40 to strike firing pin 46. In order enable firearm 10, body 71 is rotated in the direction of arrow R to its position in FIG. 7.

As shown in FIG. 9, disablement mechanism 70 disables firearm 10 to prevent firing of a cartridge when hammer 40 is trigger actuated. When hammer 40 is cocked, spring 54 is compressed and upper surface 55 of spring cap 50 is positioned below body 71. To disable firearm 10, body 71 is moved from its position in FIG. 7 to by rotating body 71 about axis L in the direction of arrow S so body 71 extends into spring well 66. In the position of FIG. 9, body 71 contacts upper surface 55 of spring cap 50 to limit upward displacement of main spring 54. Disablement mechanism 70 prevents main spring 54 from displacing hammer 40 to its uncocked position. Thus, hammer 40 will not be provided with energy from main spring 54 to strike firing pin 46.

When body 71 is rotated in the direction of arrow S from its unengaged position of FIG. 7 to its engaged positions of FIGS. 8 and 9, and also in the opposite direction of arrow R, stop 74 limits rotational movement of body 71 between these positions. Main spring housing 44 has a recess 80 is formed on rearward face 44*b* of main spring housing 44. As discussed above, body 71 extends through bore 49 so end 75 is flush with rearward face 44*b* with stop 74 positioned within recess 80. Stop 74 contacts vertical wall 81 of recess 80 when either of the desired positions of body 71 is achieved, preventing further rotation of body 71. Thus, stop 71 provides for reliable enablement and disablement of firearm 10 by providing tactile feedback to the person manipulating the disablement mechanism 70 when the desired position is reached.

It is preferred that first end 73 of body 71 be adjacent to or flush with gripping surface 44*a* for easy access and visualization by the user of firearm 10. Tool engagement openings 76 are provided to allow a user possessing the requisite tool or key to rotate body 71 for engagement and disengagement of disablement mechanism 70 as described above. Tool engagement means 76 can assume any one of a number of configurations, such as, for example, a hex opening, an opening for an allen wrench, a square opening, or one or more holes sized and spaced to accommodate a specific type of key. It is also contemplated herein that indicator means be provided on, for example, gripping surface 44*a* so that the user of firearm 10 can have visual confirmation of the status of disablement mechanism 70. For example, tool engagement opening 76 or some other marking on end 73 may be aligned with a green dot when disablement mechanism 70 is engaged, thus indicating the firearm is disabled. When disablement mechanism 70 is disengaged and the firearm is enabled, tool engagement means may be aligned with a red dot. Other types of indicator mechanisms are also contemplated herein as would occur to those skilled in the art.

Figure 12:
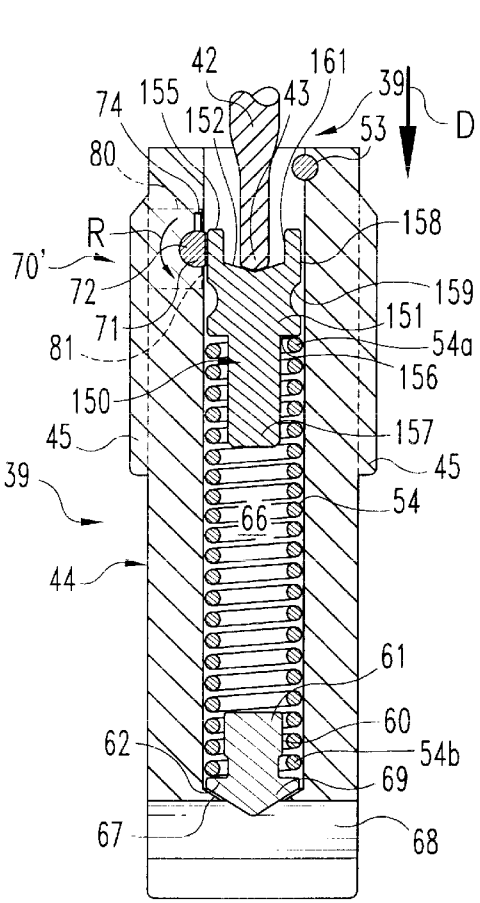
FIG. 12 is the view of FIG. 10 with the disablement mechanism in the unengaged position after the hammer has been cocked.
Figure 11:
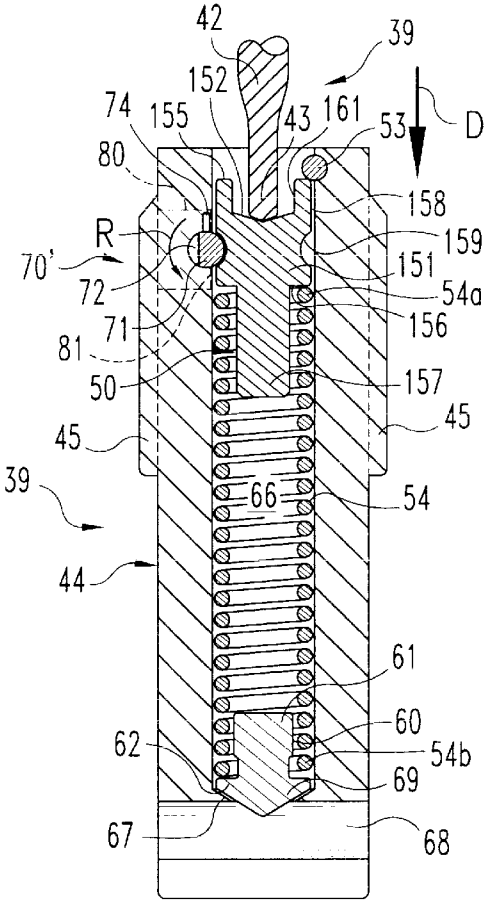
FIG. 11 is the view of FIG. 10 with the disablement mechanism in the engaged position.
Figure 10:
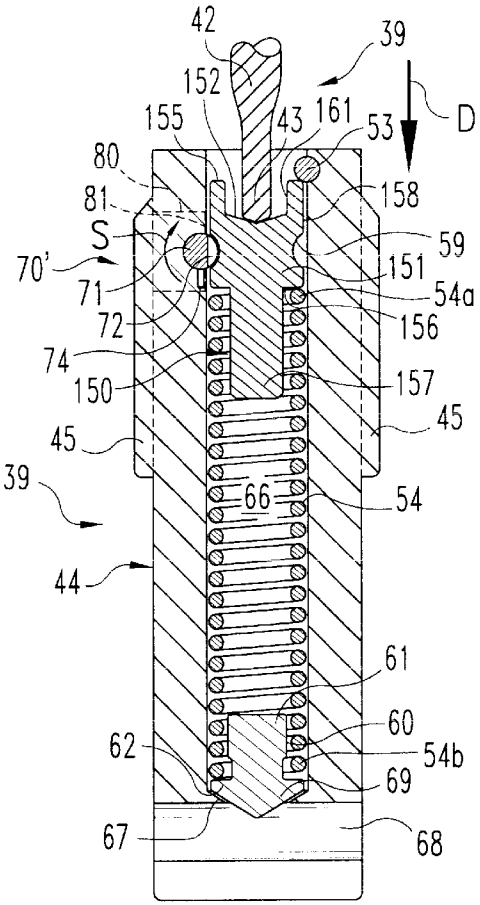
FIG. 10 is similar to the cross-sectional view taken through line 7—7 of FIG. 5 with the disablement mechanism in the unengaged position and showing an alternate embodiment spring cap.

Referring now to FIGS. 10–12, the operation of an alternate embodiment disablement mechanism 70' will now be described. Disablement mechanism 70' includes body 71 and a spring cap 150. Spring cap 150 has a head portion 151 and a shaft portion 157 extending from head portion 151. Head portion 151 has an upper surface 155 that contacts block 53 to maintain main spring 54 and spring cap 150 in well 66. Head portion 151 also includes a flange 158 extending around head portion 151 defining a cup portion 161. Cup portion 161 has a bottom surface 152 in contact with end 43 of hammer strut 42. Head portion 151 also defines shoulder portion 156 opposite upper surface 155 that rests upon end 54*a* of main spring 54. Positioned between upper surface 155 and shoulder 156 is groove 159 extending circumferentially about head portion 151. Groove 159 preferably has a semi-circular cross section allowing body 71 to be rotatably received therein. Preferably, groove 159 has a size and shape substantially corresponding to that of body 71 for a smooth fit therewith.

FIG. 10 shows firearm 10 in an enabled condition with disablement mechanism 70' in a first position. Notch 72 of body 71 is positioned adjacent spring cap 150. In this position, the hammer spring assembly 39 is free to move downwardly in the direction indicated by arrow D as hammer 40 is cocked, thus compressing main spring 54 within main spring housing 44. In this first position, disablement mechanism 70' is disengaged and the firearm is enabled, i.e. it may be used as it normally would to fire a cartridge.

In order to disable the firearm when the hammer is uncocked, disablement mechanism 70' is moved to a second position where body 71 extends into spring well 66 as shown in FIG. 11. Body 71 is rotated from its first position of FIG. 10 in the direction indicated by arrow S until a second position shown in FIG. 11 is achieved, where firearm 10 is disabled. In this second position, notch 72 is positioned away from the spring cap 150, and body 71 is received within groove 159 of spring cap 150. Hammer assembly 39 is prevented from moving in the direction of arrow D since body 71 blocks movement of spring cap 150. Hammer 40 is unable to be moved from its uncocked position to its cocked position, and main spring 54 cannot be tensioned to impart the necessary energy to cause the hammer 40 to strike firing pin 46. In order enable firearm 10, body 71 is rotated from its second position in the direction of arrow R to its first position.

As shown in FIG. 12, disablement mechanism 70' cannot disable firearm 10 to prevent firing of a cartridge when hammer 40 is cocked. When hammer 40 is cocked, main spring 54 is compressed. Flange 158 extends upwardly from bottom surface 152 of cup portion 161 a sufficient distance so that upper surface 155 of spring cap 150 is positioned adjacent to or above body 71. When hammer 40 is cocked, flange 158 of spring cap 150 blocks disablement mechanism 70' so that it cannot be moved from is first position to its second position as discussed above. Thus, disablement mechanism 70' is not operable when hammer 40 is in its cocked position, and disablement mechanism 70' can only disable hammer 40 when hammer 40 is uncocked.

It is preferred that the components of disablement mechanisms 70, 70' have sufficient strength so that, when the gun us disabled, a component of the trigger assembly or hammer strut will fail before the components. This is particularly important if an unauthorized user attempts to use force to overcome or break the disablement mechanisms 70, 70'. Disablement mechanisms 70, 70' discourage theft of guns because, without the proper tool or key for disengaging the mechanism, disassembly of the firearm 10 is required to return it to an operable condition.

From the foregoing description, it should be apparent that the present invention presents many advantages. Disablement mechanisms 70, 70' are simple to use. Also, disablement mechanisms 70, 70' are versatile since firearm 10 can be disabled if the hammer is either cocked or uncocked. Disablement mechanisms 70, 70' are easily integrated into the design of existing firearms since each requires few additional components and minimum modification to existing firearm components. Disablement mechanisms 70, 70' may be sold as part a new firearm 10, or integrated into replacement component to existing firearms. When engaged, the disablement mechanisms 70, 70' prevent or deter unauthorized use of the firearm, and protect children who might gain access to the firearm. Given the ease of use and ability to integrate with existing firearms, firearm owners will not be discouraged from using or installing disablement mechanisms 70, 70'.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. For example, by way of illustration and not limitation, strut 42 of hammer 40 may be modified in such a manner that disablement mechanisms 70, 70' could be operable to engage and disengage strut 42 to disable firearm 10.

What is claimed is:

1. An apparatus for firing a cartridge, comprising:

a firearm including a hammer assembly movable between a cocked position and an uncocked position;

said firearm further including a trigger assembly connected with said hammer assembly for releasing said hammer assembly from said cocked position upon actuation of said trigger assembly;

a spring cap positioned on a main spring, said spring cap in contact with said hammer assembly, said main spring being tensioned upon cocking of said hammer assembly to thereafter cause said firearm to fire the cartridge upon actuation of said trigger assembly; and a body having a first position wherein said hammer assembly can be moved from said uncocked position to said cocked position, said body having a second position blocking said spring cap to prevent said hammer assembly from being moved from said uncocked position to said cocked position, wherein said spring cap is configured to prevent said body from being moved to said second position when said hammer assembly is in said cocked position.

2. The apparatus of claim 1, wherein said hammer assembly includes a hammer strut pivotally connected at one end with a hammer, said hammer strut having a length extending to an opposite end in contact with said spring cap.

3. The apparatus of claim 1, wherein said spring cap has a head portion sized and configured to prevent said body from being moved to said second position when said hammer assembly is in said cocked position.

4. The apparatus of claim 3, wherein said head portion includes a flange defining a cup portion, said cup portion receiving said hammer strut.

5. The apparatus of claim 4, wherein said flange blocks said body from being moved to said second position.

6. The apparatus of claim 4, wherein said flange includes a top surface around said cup portion, said head portion having an opposite shoulder abutting said spring, and a groove between said top surface and said shoulder.

7. The apparatus of claim 6, wherein said body is positioned in said groove when in said second position.

8. An apparatus for disabling a firearm, the firearm including a hammer having a hammer strut extending therefrom, the hammer movable between a cocked position and an uncocked position, a trigger assembly for releasing the hammer from the cocked position upon actuation of the trigger assembly, and a spring positioned within a well of a spring housing, the spring being tensioned upon cocking of the hammer to provide energy to the hammer, the apparatus comprising:

a spring cap having a head portion positioned on the spring, the hammer strut having an end abutting said head portion of said spring cap, wherein said head portion includes a flange defining a cup portion for receiving the end of the hammer strut, a shoulder abutting said spring opposite said flange, and a groove between said flange and said shoulder; and a body received within a bore in the spring housing, and if the hammer is in the uncocked position said body is movable from a first position to a second position wherein said body blocks movement of said head portion of said spring cap, said body being substantially cylindrical and having a first end, an opposite second end and a length extending therebetween, said body defining a notch along a portion of said length, wherein said head portion of said spring cap is configured to block said body from being positioned within the well of the spring housing when the hammer is in the cocked position.

9. A spring cap for a firearm, the firearm including a disablement mechanism and having a hammer movable between a cocked position and an uncocked position, and a spring positioned within a well of a spring housing, the spring being tensioned when the hammer is in the cocked position, the spring cap comprising:

a shaft portion positionable in said spring; and a head portion extending from said shaft portion positionable on the spring, the hammer being in contact with said head portion, said head portion being configured to prevent the disablement mechanism from disabling the firearm when the hammer is in the cocked position.

10. The spring cap of claim 9, wherein said head portion includes:

an upper flange defining a cup portion;

a shoulder opposite said flange abutting the spring; and a groove between said flange and said shoulder.

11. The apparatus of claim 10, wherein said groove receives the disablement mechanism to disable the firearm when the hammer is in the uncocked position.

12. An apparatus for disabling a firearm, the firearm including a hammer having a hammer strut extending therefrom, the hammer movable between a cocked position and an uncocked position, a trigger assembly for releasing the hammer from the cocked position upon actuation of the trigger assembly, and a spring positioned within a well of a spring housing, the spring being tensioned upon cocking of the hammer to provide energy to the hammer, the apparatus comprising:

a spring cap having a head portion positioned on the spring, the hammer strut having an end abutting said head portion of said spring cap;

a body received within a bore in the spring housing, and if the hammer is in the uncocked position said body is movable from a first position to a second position wherein said body blocks movement of said head portion of said spring cap;

wherein said head portion of said spring cap is configured to block said body from being positioned within the well of the spring housing when the hammer is in the cocked position.

13. The apparatus of claim 12, wherein said head portion includes:

a flange defining a cup portion, said cup portion receiving the end of the hammer strut;

a shoulder abutting said spring opposite said flange; and a groove between said flange and said shoulder.

14. The apparatus of claim 13, wherein said body is received within said groove of said spring cap when said body is in said second position and the hammer is in the uncocked position.

15. The apparatus of claim 13, wherein said notch is positioned adjacent said spring cap when said body is in said first position.

16. The apparatus of claim 12, wherein said body is cylindrical and has a first end, an opposite second end and a length extending therebetween, said body defining a notch along a portion of said length.

17. The apparatus of claim 16, wherein said first end of said body includes means for engaging a tool for moving said body between said first and second positions.

18. The apparatus of claim 16, wherein said body includes a stop pin extending therefrom adjacent said second end so that said body cannot be moved beyond said first and second positions.

19. The apparatus of claim 18, wherein said first end of said body includes means for engaging a tool for moving said body between said first and second positions.

20. The apparatus of claim 8, wherein said body includes a stop pin extending therefrom adjacent said second end so that said body cannot be moved beyond said first and second positions.

* * * * *

UNITED STATES PATENT AND TRADEMARK OFFICE

CERTIFICATE OF CORRECTION

PATENT NO. : 6,691,445 B2
DATED : February 17, 2004
INVENTOR(S) : Charles David Williams It is certified that error appears in the above-identified patent and that said Letters Patent is hereby corrected as shown below:

Column 10,
Line 60, please change "18" to -- 8 --.

Signed and Sealed this

Twentieth Day of July, 2004

JON W. DUDAS
*Acting Director of the United States Patent and Trademark Office*